US006884124B1

(12) United States Patent
Luzzi

(10) Patent No.: US 6,884,124 B1
(45) Date of Patent: Apr. 26, 2005

(54) BARRIER HEAD BOLT FOR USE WITH DISCONNECTABLE JOINTS AND METHODS OF USING THE SAME

(75) Inventor: Glenn J. Luzzi, Mt. Bethel, PA (US)

(73) Assignee: Richards Manufacturing Company, Irvington, NJ (US)

( * ) Notice: Subject to any disclaimer, the term of this patent is extended or adjusted under 35 U.S.C. 154(b) by 0 days.

(21) Appl. No.: 10/701,543

(22) Filed: Nov. 5, 2003

(51) Int. Cl.[7] ..... H01R 4/36

(52) U.S. Cl. ..... 439/810; 439/801; 439/521; 29/854

(58) Field of Search ..... 439/810, 801, 439/829, 521, 475, 793; 174/88 R; 29/854, 869

(56) References Cited

U.S. PATENT DOCUMENTS 4,764,132 A * 8/1988 Stutz, Jr. ..... 607/116
5,419,714 A * 5/1995 Nagamine ..... 439/364
5,630,735 A * 5/1997 Eckert ..... 439/721
5,944,551 A * 8/1999 Kline et al. ..... 439/418
6,053,780 A * 4/2000 Ono et al. ..... 439/810
6,390,829 B1 * 5/2002 Rademacher ..... 439/74
6,663,443 B1 * 12/2003 Smith et al. ..... 439/811
2001/0003075 A1 * 6/2001 Nagayasu ..... 439/521

* cited by examiner

*Primary Examiner*—Michael C. Zarroli
(74) *Attorney, Agent, or Firm*—Stroock & Stroock & Lavan LLP

(57) ABSTRACT

A barrier head bolt for use in power feeder applications including a main bolt portion and an extended torque head portion, the torque head portion designed and constructed to shear off the main body of the bolt at a predetermined torque, and which projects above the main body portion a sufficient distance so as to inhibit or prevent the application of a joint sleeve without first shearing off the extended torque head portion of the bolt, thus ensuring that the joint is properly tightened.

13 Claims, 7 Drawing Sheets

BARRIER HEAD BOLT FOR USE WITH DISCONNECTABLE JOINTS AND METHODS OF USING THE SAME

TECHNICAL FIELD OF THE INVENTION

The present invention relates to barrier head bolts, and, in particular, an improved barrier head bolt for use with disconnectable electrical joints typically used in power feeder applications. More specifically, the present invention relates to an improved barrier head bolt for use with disconnectable joints that connect cable segments that require multiple joints for each application.

BACKGROUND OF THE INVENTION

Disconnectable joints are typically used in power feeder applications. Such applications typically comprise three phases, requiring three joints for each jointing application. Thus, in a straight joint there are six bolts that must be hand tightened and subsequently tightened to the appropriate torque. For a tap configuration, a "Y" joint is used, requiring nine bolts. Finally, in a 4-way configuration an "H" joint is used, requiring a total of twelve bolts.

Installation of the joints can be difficult, because every bolt must be handtightened and subsequently torqued, using conventional methods commonly known in the art, to ensure proper connection. In a typical installation, in order to ensure proper alignment of the articles being connected, for example, cables, lugs and buses, the splicer must handtighten each bolt, and upon verifying the joint alignment, torque the bolts to 50 to 60 foot-pounds. Once the bolts are tightened to the appropriate torque, the splicer can then slide sleeves into place to cover the bolts and seal the connections.

There are many problems with the currently used methods and joints. First, the splicing procedure is typically performed in manholes or in otherwise extremely confined conditions, limiting the freedom of motion of the splicer. Additionally, when the "Y" or "H" joints are used, half of the bolts must be attached from the underside of the joint, thereby rendering the installation even more difficult. Also, if the cables are located on the lower racks, the splicer may need to work on his knees, further complicating the splicing procedure. Furthermore, a torque tool, such as a torque wrench, is needed to torque the bolts. These torque tools, however, may be difficult to maneuver in the confined space in which the splicer is operating. Given many of the difficulties in attaching the bolts, in many instances the splicer either fails to do the final torqueing operation or does not torque the bolts to the correct torque, creating a potential failure point in the joint.

In light of the shortcomings of the conventional methods and applications known in the art, it is desirable to provide a device that ensures proper tightening of the final assembly of the joint and/or which eliminates the need for the torque tool.

SUMMARY OF THE INVENTION

The present invention relates to a novel barrier head bolt that can be used in power feeder applications, including, for example, straight joints, "Y" joints, and "H" joints. In particular, the present invention is directed towards an improved barrier head bolt for use with a disconnectable joint, wherein the bolt comprises an extended torque head portion that is designed and constructed to shear off the main body of the bolt at a predetermined torque. The present invention is also directed toward a novel barrier head bolt that comprises a torque head portion that projects above the main body portion of the bolt a sufficient distance so as to inhibit or prevent the application of a joint sleeve without first shearing off the extended torque head portion of the bolt, thus ensuring that the joint is properly tightened.

In particular, the present invention relates to an improved barrier head bolt that is designed and constructed so as to ensure that the joint bolts are tightened to the proper torque before the joint sleeve can be placed on the joint itself, thus eliminating and/or reducing the potential for operator error. By ensuring that the torque head portion is sheared off prior to positioning the joint sleeve, the present invention confirms that the bolts are tightened properly, which ensures proper installation.

The present invention is also related to an improved barrier head bolt that simplifies the installation process by eliminating the need for a torque tool. In particular, the present invention allows the splicer to confirm the torque of the bolts without the use of a torque tool by providing a barrier head bolt with an extended height torque head that will shear off when a predetermined torque level is reached.

Thus, it is an object of the present invention to provide an improved barrier head bolt for use with a disconnectable joint and a method of installing the same.

Also, it is an object of the present invention to provide an improved barrier head bolt for use with a disconnectable joint that can confirm the required torque of the bolt is obtained, without the use of a torque tool, prior to complete installation of the joint, and a method of installing the same.

Further, it is an object of the present invention to provide an improved method of installing a disconnectable joint that can eliminate the need for a torque tool without sacrificing accuracy.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forthwith particularity in the claims as appended or as subsequently amended, but merely to clarify and exemplify the invention.

For a more complete understanding of the present invention, reference is now made to the following drawings in which.

DETAILED DESCRIPTION OF A PREFERRED EMBODIMENT OF THE INVENTION

Figure 1A:
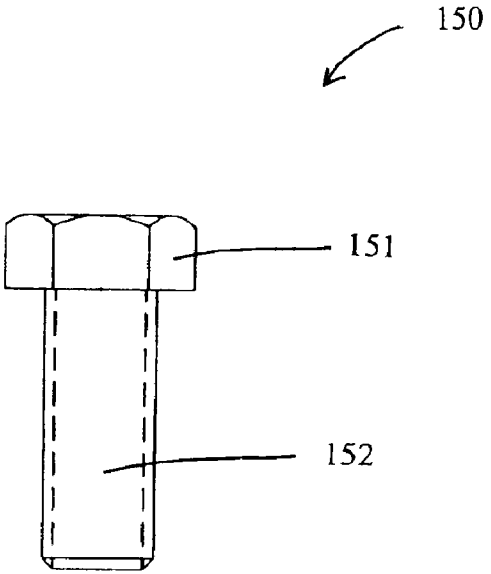
FIGURE 1A (PRIOR ART)
FIG. 1A is a front view of a prior art bolt for use with a disconnectable joint.
Figure 1B:
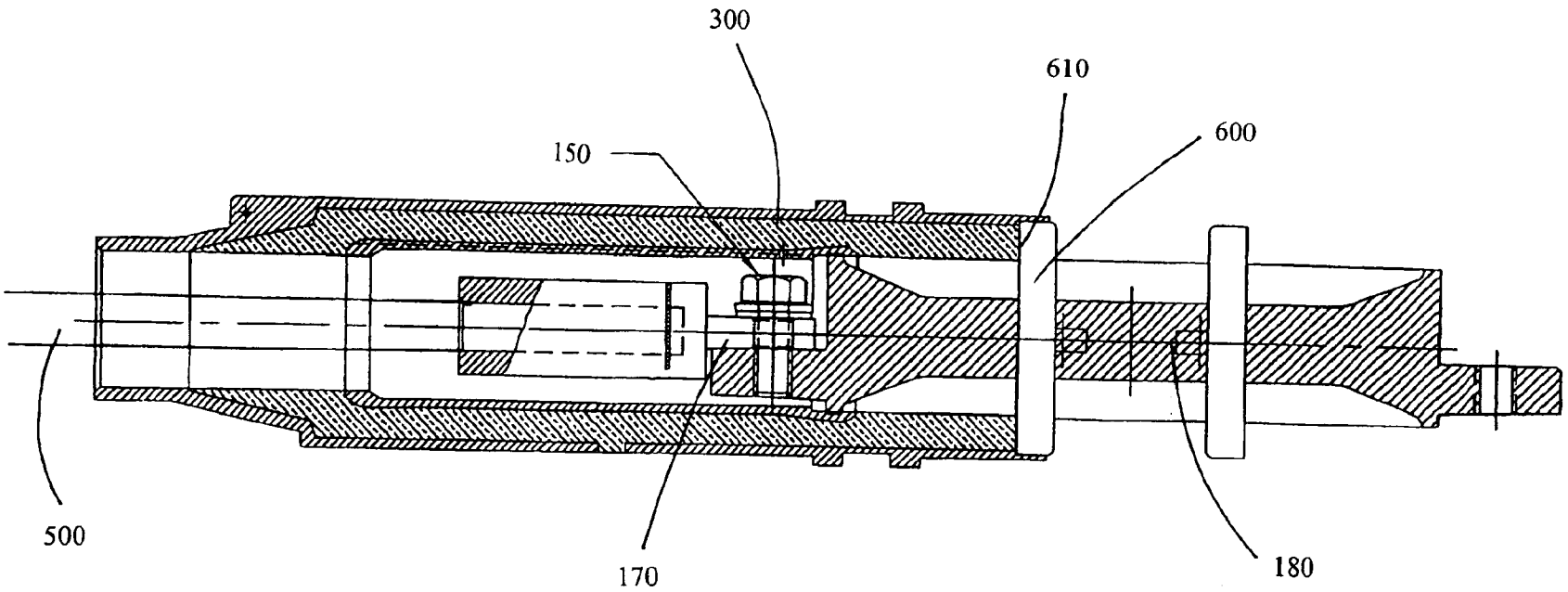
FIGURE 1B (PRIOR ART)
FIG. 1B is a cross-sectional view of a prior art joint including a joint sleeve with the prior art bolt installed therein.

FIG. 1A depicts the prior art bolts typically used to connect disconnectable joints. As seen in FIG. 1A, bolt 150 generally comprises a head portion 151 that is flat and hexagonal, and a threaded shaft portion 152. FIG. 1B shows a disconnectable "I" (or straight) joint 180, attached to the lug 170 of cable 500 via a prior art bolt 150, with a sleeve 300 fitted into place over the connection. According to a method known in the art, to accomplish the connection, sleeve 300 is first placed over the cable 500, then bolt 150 is used to connect the joint 180 to the lug 170 attached to the cable 500. To ensure proper functioning, bolt 150 is generally tightened to a pre-set torque, for example 50 to 60 foot-pounds. Once properly tightened, joint sleeve 300 is slid over the connection at bolt 150 until a leading end 610 of sleeve 300 mates with sleeve mating portion 600 of joint 180.

As described above, given the difficulties of making the joint connection, bolt 150 is often not tightened to the proper torque. As seen in FIG. 1B, it is possible to slide sleeve 300 over prior art bolt 150 and make the contact with sleeve mating portion 600 regardless of whether bolt 150 has been properly tightened. In fact, sleeve 300 could be slid over the connection at bolt 150 even if bolt 150 were only hand tightened. The improved barrier head bolt of the present invention is directed towards eliminating and/or reducing this potential failure point on the joint system.

Figure 2:
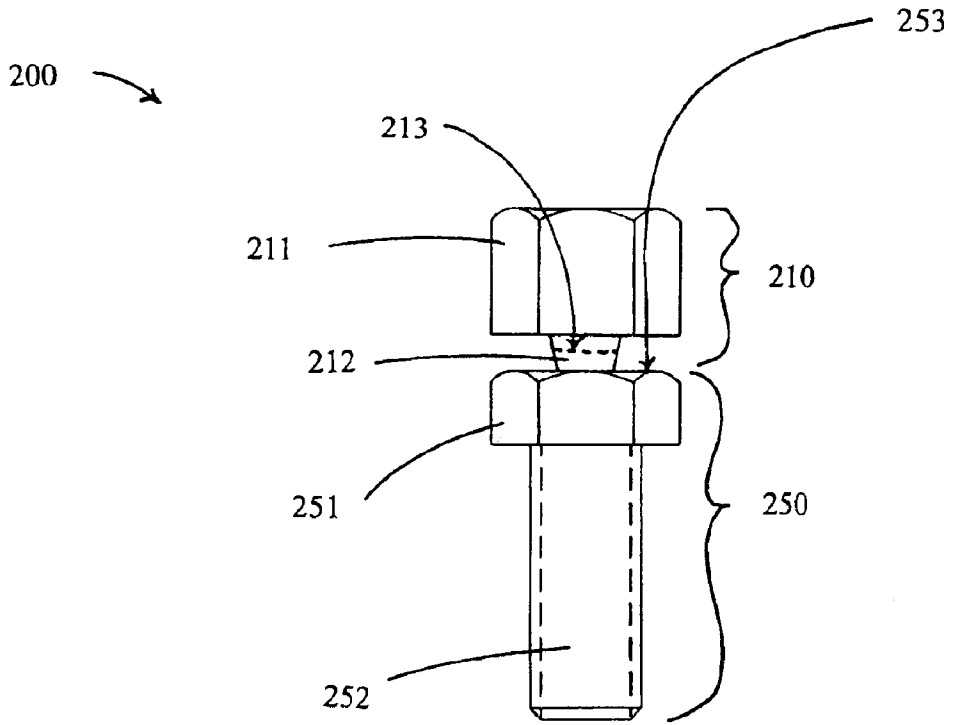
FIG. 2 is a front view of the improved barrier head bolt according to an embodiment of the present invention.

FIG. 2 shows an embodiment of the improved barrier head bolt 200 of the present invention. As seen in FIG. 2, the improved barrier head bolt 200 comprises a torque head portion 210, which protrudes from main bolt portion 250 a predetermined distance. In a preferred embodiment, main bolt portion 250 comprises a head portion 251 and a threaded shaft portion 252, with the head portion 251 and shaft portion 252 generally designed to have similar and/or the same dimensions as prior art bolt 150, in particular with respect to length and width, to facilitate the use of barrier head bolt 200 in pre-existing joint connections. While main bolt portion 250 may have the same length as prior art bolt 150, barrier head bolt 200 will have an overall longer length than the prior art bolt 150 as described in more detail below. In a preferred embodiment, barrier head bolt 200 is a single integrated piece. In an alternative embodiment, torque head portion 210 and main bolt portion 250 are separate piece that a rejoined to form an integrated barrier head bolt 200.

Figure 4:
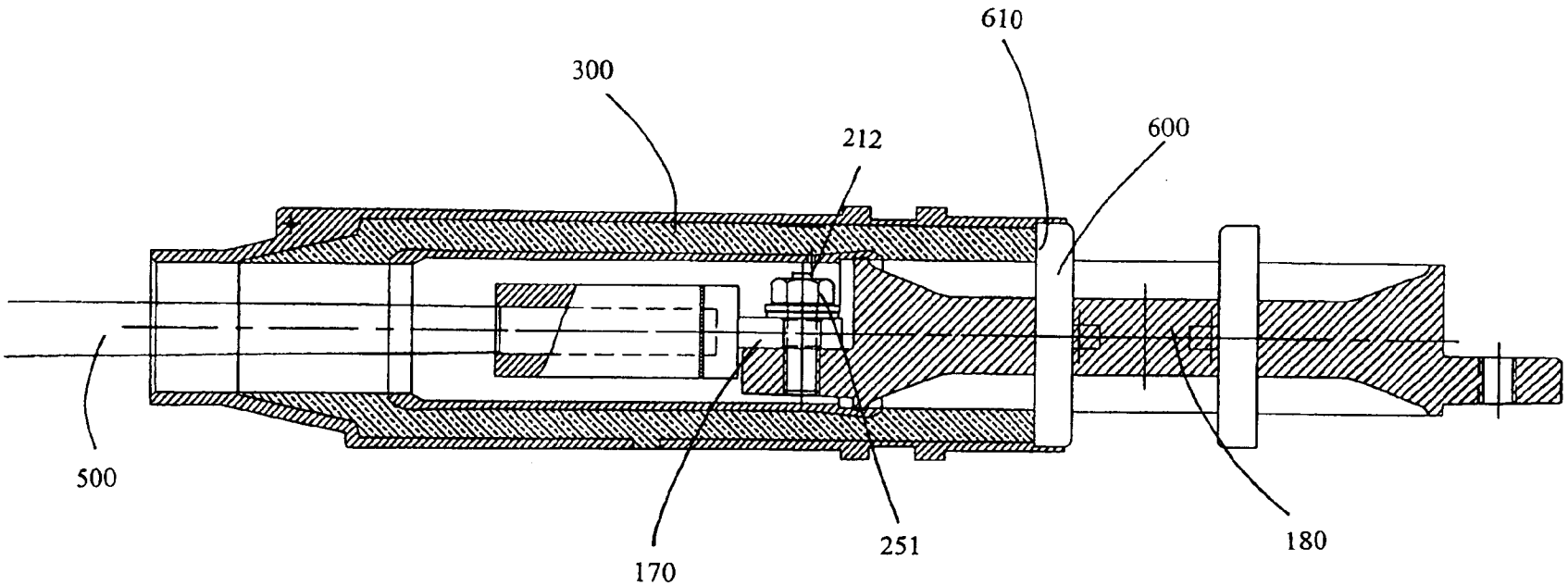
FIG. 4 is a cross-sectional view of the improved barrier head bolt and joint according to an embodiment of the present invention after the torque head portion is sheared off and the joint sleeve is in place.

As seen in FIG. 2, torque head portion 210 of barrier head bolt 200 generally comprises an extended head portion 211 and a stem portion 212. In a preferred embodiment, extended head portion 211 and stem portion 212 are formed of a single integrated piece, while in an alternative embodiment extended head portion 211 and stem portion 212 are formed as separate pieces that a rejoined together. In a preferred embodiment stem portion 212 extends from surface 253 of head portion 251 of main bolt portion 250. Stem portion 212 is designed such that the extended head portion 211 of barrier head bolt 200 will break off from the main bolt portion 250 when a pre-determined amount of torque is applied to the extended head portion 211. Stem portion 212 may be designed to remain filly attached to extended head portion 211 or main bolt portion 250, or remain partially attached to either or both extended head portion 211 and main bolt portion 250, as a matter of application specific design choice. Torque head portion 210 and main bolt portion 250 can be formed of the same material or different materials, as a matter of application specific design choice. As an example, FIG. 4 shows an embodiment of stem portion 212 split at approximately a midway point between extended head portion 211 and main bolt portion 250. In a preferred embodiment of the present invention, stem portion 212 is cut off at a predetermined location by creating an undercut 213 in the stem portion 212.

In a preferred embodiment, stem portion 212 is constructed and designed to have a thinner width than the width of shaft portion 252 of main bolt portion 250. In a preferred embodiment, the stem portion 212 is designed to shear off at approximately between 50 to 60 foot-pounds of torque. Although FIG. 2 shows stem portion 212 having a generally cylindrical shape with differing diameters, the present invention is not limited to any particular shape or length so long as a part of, or all of, torque head portion 210 will shear off at the pre-determined amount of torque, and so long as torque head portion 210 extends from main bolt portion 250 a sufficient distance to achieve its intended purpose.

Extended head portion 211 can comprise a hexagonal shape and the upper surface of extended head portion 211 can be flat, making it suitable for tightening or loosening using conventional tools available in the market. Whereas the width of extended head portion 211 is shown as being equal to the width of head portion 251, the width of extended head portion 211 can be greater or smaller without departing from the scope of the present invention.

Figure 3:
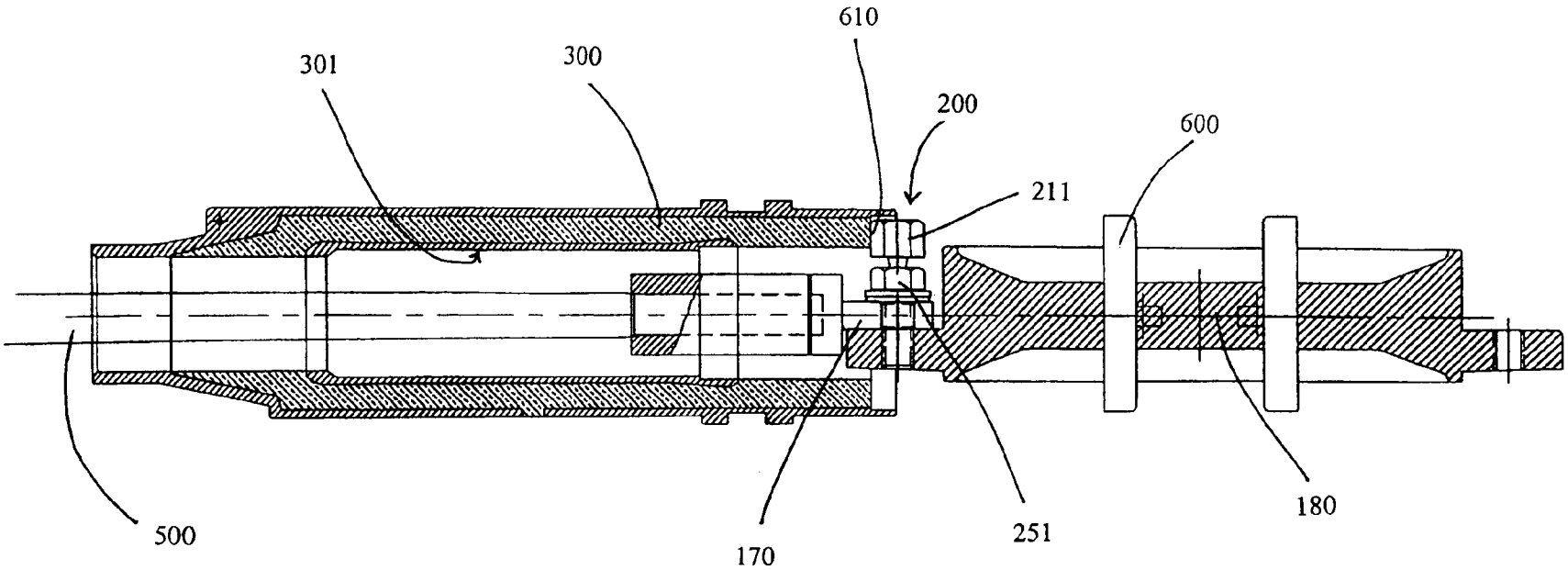
FIG. 3 is a cross-sectional view of the improved barrier head bolt of the present invention installed within a disconnectable joint before the torque head portion of the bolt has been sheared off, demonstrating that the joint sleeve cannot be fit into place while the torque head portion is still attached.

As described in more detail below, barrier head bolt 200 is designed to ensure that main bolt portion 250 is tightened to the proper pre-determined torque prior to completing the joint installation. That is, the improved barrier head bolt 200 of the present invention is designed to prevent sleeve 300 from being slid into proper position unless and until main bolt portion 250 is properly tightened. As seen in FIG. 3, and as described in more detail below, prior to being sheared off, torque head portion 210 (or a part thereof) of barrier head bolt 200 extends beyond inner wall 301 of sleeve 300 a sufficient distance so as to block sleeve 300 from moving any further toward sleeve mating portion 600 of joint 180. Therefore, the full connection cannot be made (i.e., sleeve 300 cannot be fit into proper place) unless and until extended head portion 211 is sheared off from main bolt portion 250 by applying the proper pre-determined torque to barrier head bolt 200.

Figure 5:
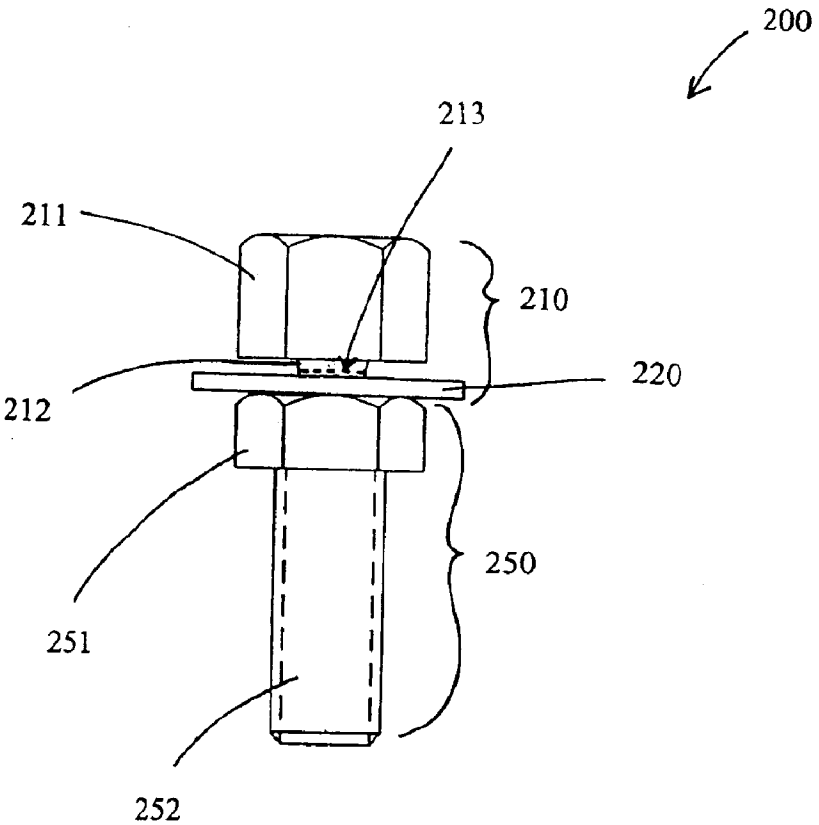
FIG. 5 is a front view of the improved barrier head bolt according to an embodiment of the present invention including a barrier plate.

In an alternate embodiment, as seen in FIG. 5, barrier head bolt 200 can comprise a barrier plate 220 along stem portion 212 to aid in preventing the splicer's tool from inadvertently engaging head portion 251. Barrier plate 220 can be made of plastic or metal or any other material. Once extended head portion 211 detaches from main bolt portion

Figure 6B:
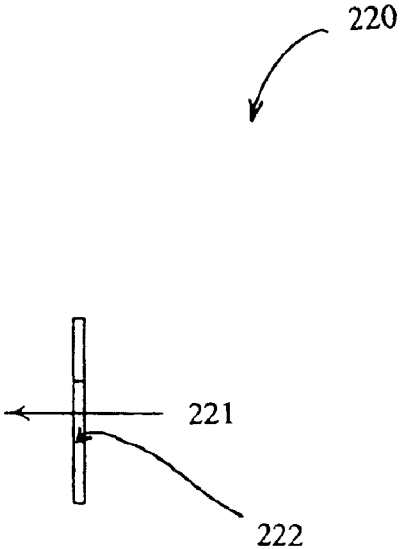
FIG. 6B is a cross sectional view of the barrier plate of FIG. 5.
Figure 6A:
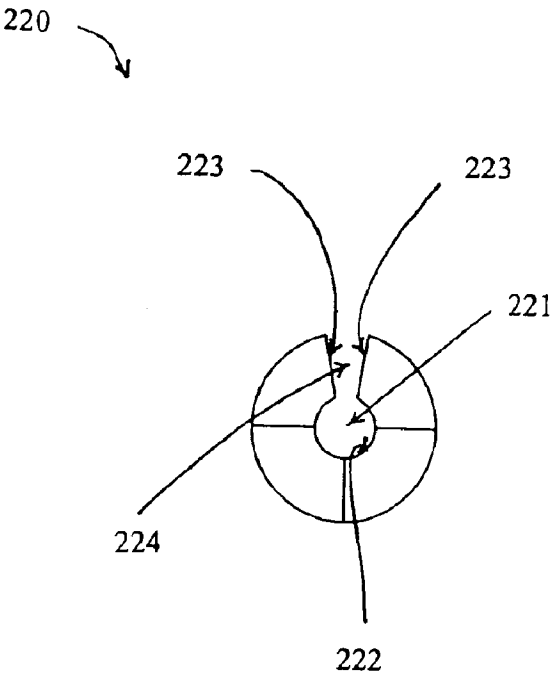
FIG. 6A is a front view of a preferred embodiment of the barrier plate of FIG. 5.

250, barrier plate 220 can be removable from main bolt portion 250. As shown in FIG. 6A, barrier plate 220 can be generally round and flat, having an inner surface 222 defining aperture 221, wherein inner surface 222 surrounds stem portion 212. Barrier plate 220 can also comprise slot surfaces 223 defining slot aperture 224, which facilitates positioning of barrier plate 220 around stem portion 212. FIG. 6A shows barrier plate 220 as generally round and flat having apertures 221 and 224, but it is to be understood that barrier plate 220 may be any number of shapes or configurations such as protruding members that extend from stem portion 212, as a matter of application specific design choice. Barrier plate (or member) 220 can be formed integral with stem portion 212 or as a separate piece as a matter of application specific design choice.

The installation process of an embodiment of the present invention applied to an "I" joint, in reference to FIGS. 2–4, will now be discussed in more detail. Sleeve 300 is placed over cable 500, and then barrier head bolt 200 is hand tightened in order to connect joint 180 to lug 170 (which is attached to cable 500). Barrier head bolt 200 is then tightened further by a conventional wrench or other tool. Preferably, barrier head bolt 200 is tightened via extended head 211. When barrier head bolt 200 is being tightened, the twisting action requires a certain torque, which represents how tightly barrier head bolt 200 is being tightened. When main bolt portion 250 is tightened to the required tightness, applying more force to extended head portion 211 will result in a part or all of torque head portion 210 detaching from main bolt portion 250. Once torque head portion 210 detaches from main bolt portion 250, main bolt portion 250 is tightened to the proper predetermined torque and sleeve 300 can be slid over main bolt portion 250 toward sleeve mating portion 600. As mentioned above, sleeve 300 cannot pass barrier head bolt 200 unless torque head portion 210 is detached from main bolt portion 250. Sleeve 300 then engages sleeve mating portion 600, preferably via leading end 610, and seals the connection, completing the installation.

Thus, as described above, the improved bolt according to a preferred embodiment of the present invention ensures that the connection is tightened to the proper torque before the sleeve can be positioned in its proper place, thereby eliminating a potential serious failure point on the connection. The bolt of the present invention also eliminates the use of a specialized torque tool, thus further providing benefits and advantages of prior art bolts for use in connection with disconnectable joints.

In the foregoing description, the device and the method of the present invention have been described with reference to specific embodiments. It is to be understood and expected that variations in the principles of the device and method herein disclosed may be made by one of ordinary skill in the art and it is intended that such modifications, changes, and substitutions are to be included within the scope of the present invention as set forth in the appended claims. The specification and the drawings are accordingly to be regarded in an illustrative, rather than in a restrictive sense.

I claim:

1. A method for connecting a cable to a disconnectable electrical joint wherein the connection is covered by a sleeve, said method comprising:

positioning a sleeve over a cable;

providing a barrier head bolt comprising a torque head portion and a main bolt portion, wherein the torque head portion extends from the main bolt portion a sufficient distance such that the sleeve cannot be properly positioned while the torque head portion is attached to the main bolt portion;

joining the cable to a disconnectable joint via the main bolt portion of the barrier head bolt;

tightening the torque head portion to a predetermined tightness such that at least a portion of the torque head portion detaches from the barrier head bolt; and positioning the sleeve over the connection between the cable and the joint.

2. The method according to claim 1, wherein the torque head portion is tightened to about 50 to 60 foot-pounds.

3. The method according to claim 2, wherein the torque head portion is tightened via a non-torque wrench tool.

4. The method according to claim 1, wherein the torque head portion comprises an extended head portion and a stem portion and wherein the method further comprises positioning a barrier member between the torque head portion and the main bolt portion, wherein the barrier member inhibits a tool from engaging the main bolt portion.

5. The method according to claim 1, wherein the torque head portion comprises a head portion and a stem portion and where the stem portion further comprises an undercut to facilitate detachment of the extended head portion from the main bolt portion.

6. A barrier head bolt for connecting a cable to a disconnectable joint, and wherein the connection is to be covered by a sleeve, the barrier head bolt comprising:

a torque head portion and a main bolt portion, wherein the torque head portion comprises an extended head portion and a stem portion and wherein the main bolt portion is designed to connect a cable to a disconnectable joint;

at least a portion of the torque head portion extending from the main bolt portion a sufficient distance so as to inhibit the placement of a sleeve on the connection between the cable and the disconnectable joint; and the extended head portion being designed to detach from the main bolt portion at a predetermined torque, such that the sleeve can be properly positioned on the joint.

7. The barrier bolt according to claim 6, wherein the extended head portion is designed to detach at about between 50 to 60 foot-pounds.

8. The barrier bolt according to claim 6, wherein the stem portion comprises an undercut.

9. The barrier bolt according to claim 6, further comprising a barrier member positioned proximate the stem portion.

10. The barrier bolt according to claim 9, wherein barrier member is formed integral with the stem potion.

11. The barrier bolt according to claim 6, wherein the disconnectable joint is an I, Y or H joint.

12. The barrier bolt according to claim 6, wherein the torque head portion and the main bolt portion are formed as separate pieces.

13. The barrier bolt according to claim 6, wherein the extended head portion and the stem portion are formed as separate pieces.

* * * * *